United States Patent [19]

Copoulos

[11] 4,259,766

[45] Apr. 7, 1981

[54] CONDENSING TRUMPET

[75] Inventor: George J. Copoulos, Wilmington, Del.

[73] Assignee: E. I. Du Pont de Nemours and Company, Wilmington, Del.

[21] Appl. No.: 939,493

[22] Filed: Sep. 5, 1978

[51] Int. Cl.[3] ..... D01H 5/72

[52] U.S. Cl. ..... 19/150; 19/157; 19/288

[58] Field of Search ..... 19/288, 150, 157; 226/196; 242/157 R; 28/289

[56] References Cited

U.S. PATENT DOCUMENTS

| | | | |
|---|---|---|---|
| 3,216,064 | 11/1965 | Kates, Jr. | 19/243 |
| 3,246,370 | 4/1966 | West | 19/150 |
| 3,362,049 | 1/1968 | Kiser | 19/288 |
| 3,375,556 | 4/1968 | Bryan | 19/157 |
| 3,387,339 | 6/1968 | Bofill | 19/150 |
| 3,401,429 | 9/1968 | Whitehurst | 19/288 |
| 3,447,206 | 6/1969 | Klein et al. | 19/243 |
| 3,750,974 | 8/1973 | Dibrell | 28/289 X |
| 3,895,417 | 7/1975 | Zimmermann | 19/288 |
| 3,994,046 | 11/1976 | Brown et al. | 19/150 |

FOREIGN PATENT DOCUMENTS

| | | | |
|---|---|---|---|
| 406508 | 3/1934 | United Kingdom | 19/157 |

OTHER PUBLICATIONS

Research Disclosure, p. 77, Nov. 1977.

*Primary Examiner*—Louis Rimrodt

[57] ABSTRACT

A condensing trumpet for a draw frame has internal passages formed in such a way as to receive two separate sliver types and bring them together in a sheath-core arrangement where one sliver completely surrounds the other.

2 Claims, 6 Drawing Figures

CONDENSING TRUMPET

DESCRIPTION

TECHNICAL FIELD

This invention relates to drawing frames and more particularly, to a novel apparatus for blending slivers while they are being delivered to the calender rolls of a drawing frame.

BACKGROUND ART

Textile materials prepared from blends of natural and synthetic fibers are well known. One important way of preparing blends involves the combination of different slivers at the draw frame, and process and equipment arrangements for achieving a uniform blend on a draw frame have been described, for example, in U.S. Pat. Nos. 3,216,064, 3,447,206, and 3,994,046.

For some special purposes, however, a uniform blend is undesirable. For example, in polyester/cotton blend yarns used in preparation of denims, it is very desirable for the cottom fibers to remain at the surface of the yarn with the polyester fibers concentrated at the core. Yarn with a "sheath-core" structure of this type exhibits dyeability features characteristic of cotton and thus can be dyed with indigo to a satisfactory depth of shade. Unfortunately, none of the usual references has addressed the problem of combining natural and synthetic fiber slivers at the draw frame in such a manner as to insure that the natural fiber is located in the "sheath" of the yarn produced.

SUMMARY OF THE INVENTION

The preparation of a composite yarn by combining slivers of different kinds of fibers at the draw frame in such a manner as to direct one type of fiber to the "sheath" and the other type of fiber to the "core" of the resulting yarn may be achieved by utilizing a condensing trumpet of novel design above the draw frame calender rolls. A trumpet useful for this purpose is one which keeps the two types of fibrous slivers completely separated up to the point at which they are just ready to enter the nip of the calender rolls and at that point the two sliver types are brought together in such a manner that one type completely surrounds the other. The combined sliver passes between the calender rolls where its structure is stabilized and is then deposited, as customary, in a can ready for transfer to a roving frame.

The trumpet comprises an open ended member having an entrance at one end and an exit at the other end. The entrance and exit are connected by a passage for sliver which preferably is tubular or rectangular, however other cross-sectional passage shapes will produce satisfactory results. The open ended member is surrounded by a continuous wall, open at each end and spaced from the member to provide an annular passage for sliver between the wall and the member.

DETAILED DESCRIPTION OF THE ILLUSTRATED EMBODIMENTS

Figure 1:
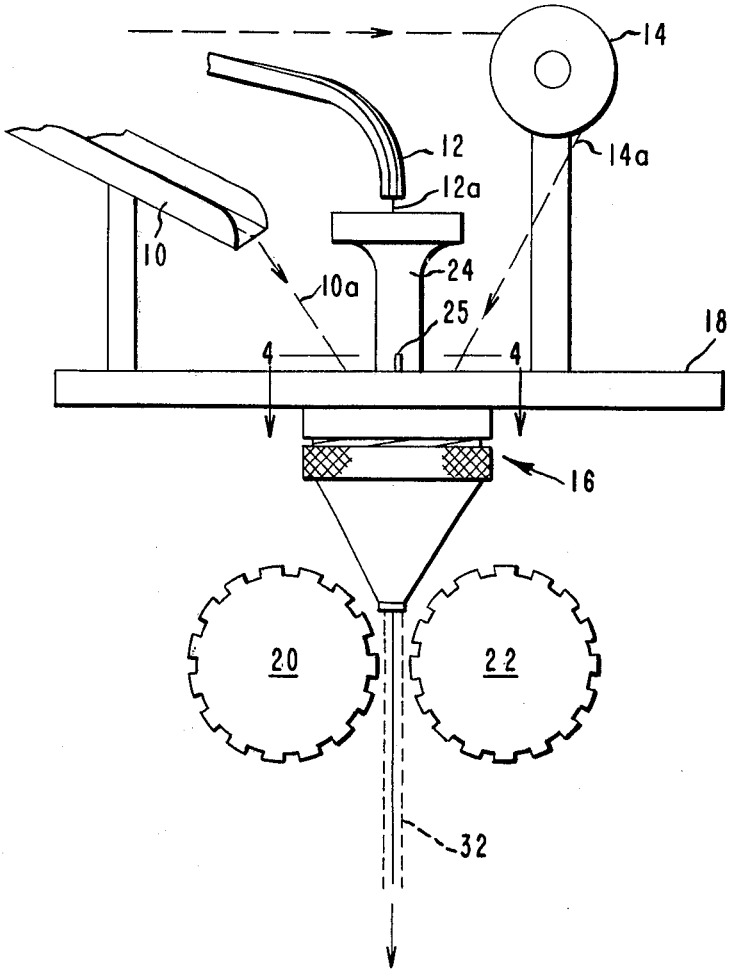
FIG. 1 is a schematic side elevation of a trumpet according to the present invention in place above the calender rolls of a draw frame in operation.

The apparatus chosen for purposes of illustration generally includes a guide 10 in the form of a trough, a curved guide 12, a roller guide 14 all for sliver and a trumpet generally designated 16 all supported by frame 18 above a pair of calender rolls 20,22.

Figure 2:
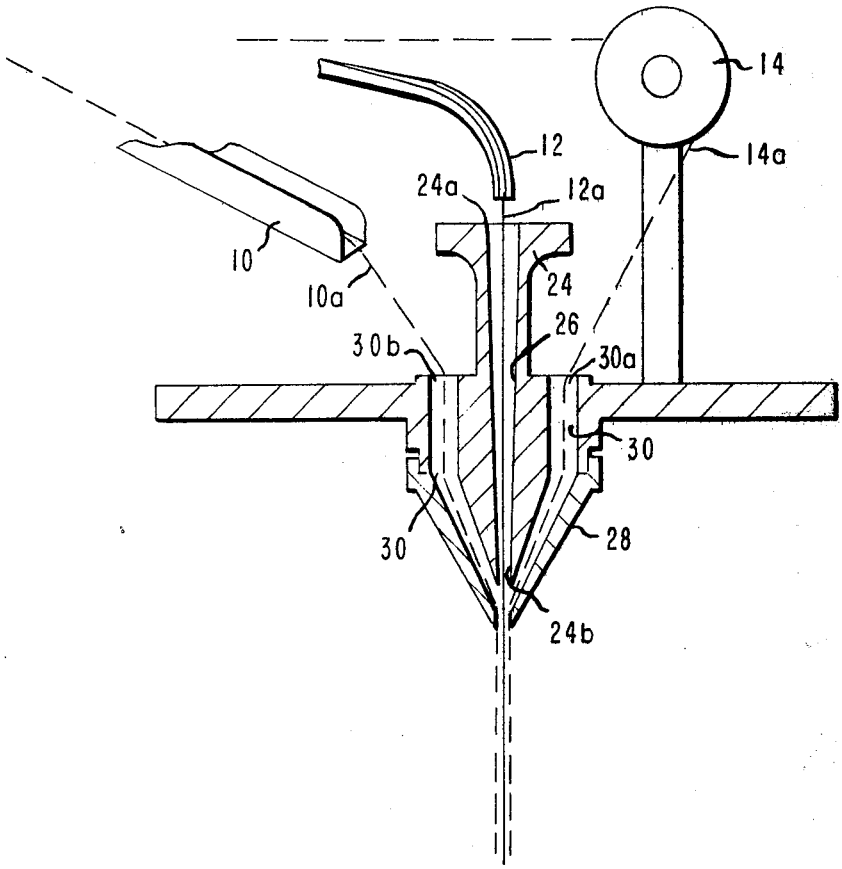
FIG. 2 is a partly sectioned view of the trumpet of FIG. 1, showing the path of two different sliver types through the trumpet.
Figure 3:
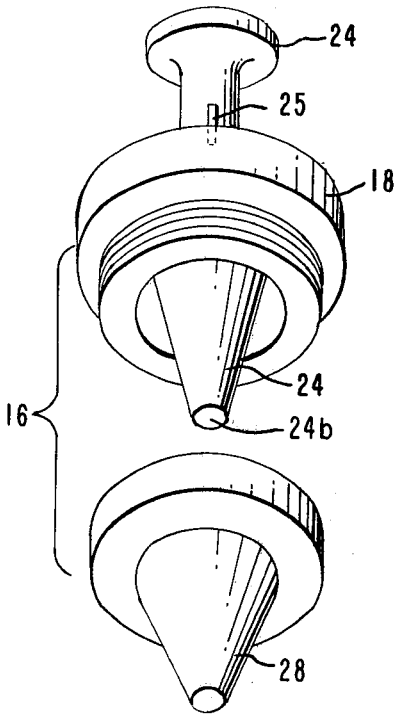
FIG. 3 is a perspective view of the trumpet of FIG. 1, separated so as to reveal its inner construction.
Figure 4:
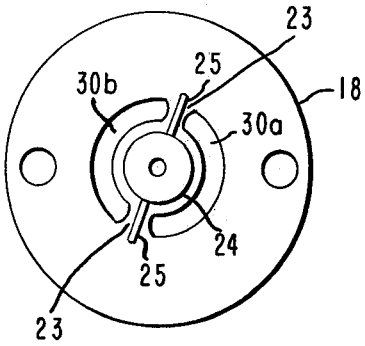
FIG. 4 is a top view of the trumpet of FIG. 1 taken along line 4—4 showing sliver receiving slots.

Referring to FIGS. 2–4, the trumpet 16, includes an open ended member 24 having an entrance **24*a* and an exit 24*b* connected by a tubular passage 26. The exit is smaller in cross section than the entrance to provide a condensing action on the sliver 12*a* as it passes through. The open ended member 24 is surrounded at its lower end by a continuous wall 28 that is spaced from the member 24 to provide an annular passage 30 there between. The wall 28 is threaded to frame 18 for support and to position it with respect to inner member 24. Slivers 10*a* and 14*a* are fed to the annular passage 30. The inner member 24 is joined to frame 18 by means of bridges 23. Ears 25 extend outwardly from member 24 and fit into slots in the top of the frame 18 in bridge members 23 (FIG. 4). The primary purpose of the ears 25 is to prevent slivers 10*a* and 14*a* from "licking" together before they enter slots 30*a* and 30*b***.

In operation a cotton sliver proceeding from the drafting rolls of the draw frame is divided into two equal portions with sliver **14*a* being led over roller guide 14 and down into outer sliver slot 30*a* while sliver 10*a* is directed by guide 10 to the other outer slot 30*b* of trumpet 16. Polyester sliver 12*a* from the drafting rolls of the draw frame is directed by means of a suitable curved guide 12 to the passage 26 in member 24 of trumpet 16. The entrance 24*a* of passage 26 is raised above the level of outer slots 30*a* and 30*b* in order to insure that there is no premature contact between the polyester sliver and the cotton slivers. The combined sliver 32 emerging from the bottom exit of trumpet 16 is immediately engaged by calender rolls 20,22** which stabilize the sheath-core structure and direct the combined sliver into the usual receiving can where it is held in readiness for transfer to a roving frame.

FIG. 2, which shows trumpet 16 in cross-section, illustrates how the internal channels of the trumpet bring the two sliver types together just above the bottom exit of the trumpet. Above this point, the outer edges of the two semi-circular sections of cotton sliver (see FIG. 4) are brought together inside the trumpet to form a completed circular sheath which completely surrounds the polyester sliver as the combination structure passes through the trumpet exit.

Figure 5:
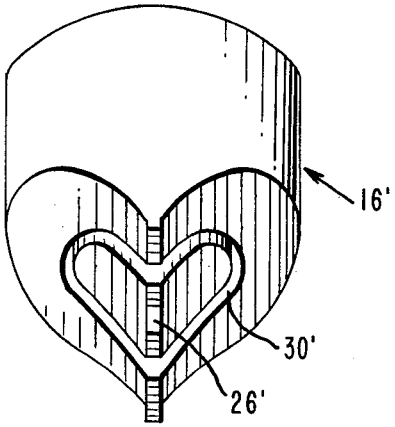
FIG. 5 is a perspective view of an alternative trumpet which allows the two types of slivers to come together after they leave the confines of the trumpet.

The alternative trumpet 16' shown in FIG. 5 is similar to the trumpet 16 in FIG. 1 at its upper end, but differs at its lower end in that the cotton sliver and polyester sliver emerge from the trumpet before contacting each other. The internal channels of the trumpet are arranged so that the two cotton sliver feed streams formed in annular passage 30' are merged into a single circular stream at the exit of the trumpet and thus completely surround the polyester sliver exiting from the central slot 26'. As shown, the underside of the trumpet is curved in such a manner as to conveniently fit into the trough formed by the juxtaposition of the two calender rolls.

Figure 6:
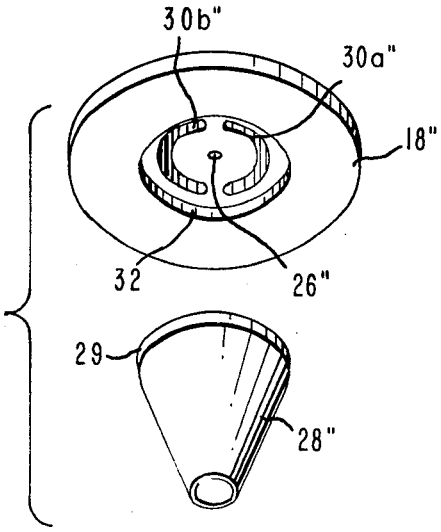
FIG. 6 is a perspective view, separated to show its inner construction, of another embodiment of the invention.

A further alternative 16'' shown in FIG. 6 differs from those described above in that the open ended member instead of being elongated is in the form of a plate with slots and a central opening surrounded by the continuous wall 28''. In this embodiment, frame 18'' in the form of a plate is recessed defining an inner wall 32 of the recess to mate with portion 29 on the outer wall 28'' in a press fit and has slots 30*a*'' and 30*b*'' machined in the recess through which the outer sliver 10*a*,14*a* passes. A hole 26'' is machined in the plate through which the core sliver 12*a* passes. The principle of operation is the same as before in forming a combination sheath core structure.

Polyester/cotton composite sliver formed by the use of a trumpet as described above may be processed into roving and drawn and twisted on a spinning frame to provide a composite yarn having essentially a sheath-core structure wherein the polyester fibers are the core fibers and the cotton fibers are the sheath fibers. Such yarns have dyeability characteristics close to that of 100% cotton yarns.

While the above description was specifically directed to the combination of a polyester fiber sliver and a cotton fiber sliver to form a composite yarn with cotton at the surface and polyester at the core of the yarn, it will be apparent other fiber types may be combined in this fashion.

I claim:

1. In a drawing frame apparatus that includes calender rolls and guide means for directing sliver to said calender rolls through a condensing trumpet located between said guide means and said calender rolls, said condensing trumpet comprising: an open ended member having an entrance at one end and an exit at its other end connected by a passage through which one sliver passes; an open ended continuous cone-shape wall surrounding said member, said wall being spaced from said member whereby an annular passage having an entrance at one end and an exit at its other end is provided between said wall and said member through which another sliver passes; and a member bridging said entrance of said annular passage.

2. The apparatus as defined in claim 1, said passage in said open ended member having a rectangular cross-section and terminating in coincidence with at least a portion of said annular passage.

* * * * *